US005816531A

United States Patent [19]

Hollis et al.

[11] Patent Number: 5,816,531

[45] Date of Patent: Oct. 6, 1998

[54] RANGE CORRECTION MODULE FOR A SPIN STABILIZED PROJECTILE

[75] Inventors: Michael S. L. Hollis, Abingdon; Fred J. Brandon, Aberdeen, both of Md.

[73] Assignee: The United States of America as represented by the Secretary of the Army, Washington, D.C.

[21] Appl. No.: 794,789

[22] Filed: Feb. 4, 1997

[51] Int. Cl.[6] ..... F42B 10/34

[52] U.S. Cl. ..... 244/3.27; 102/293

[58] Field of Search ..... 244/3.1, 3.21, 244/3.24, 3.25, 3.26, 3.27, 3.28, 3.29, 110 D, 113; 102/293, 388, 386

[56] References Cited

U.S. PATENT DOCUMENTS

| | | | |
|---|---|---|---|
| 1,181,203 | 5/1916 | Alard | 244/3.21 |
| 1,201,763 | 10/1916 | Rimailho | 244/3.21 |
| 3,098,445 | 7/1963 | Jackson | 244/3.28 |
| 3,188,958 | 6/1965 | Burke et al. | 244/3.21 |
| 3,840,326 | 10/1974 | Richardson et al. | 244/113 |
| 3,986,683 | 10/1976 | Ellison | 244/3.21 |
| 4,113,204 | 9/1978 | Leek | 244/3.21 |
| 4,512,537 | 4/1985 | Sebestyen et al. | 244/3.21 |
| 4,575,025 | 3/1986 | Sadvary et al. | 244/3.27 |
| 5,024,395 | 6/1991 | Kranz et al. | 244/3.22 |
| 5,417,393 | 5/1995 | Klestadt | 244/3.27 |
| 5,584,448 | 12/1996 | Epstein et al. | 244/3.28 |

FOREIGN PATENT DOCUMENTS

| | | | |
|---|---|---|---|
| 1184673 | 12/1964 | Germany | 244/3.27 |
| 3400083 | 8/1984 | Germany | 244/3.29 |
| 3417081 | 11/1985 | Germany | 244/3.27 |
| 3422231 | 12/1985 | Germany | 244/3.1 |
| 147200 | 5/1952 | Sweden | 244/3.27 |
| 112718 | 1/1918 | United Kingdom . | |

OTHER PUBLICATIONS

Hollis, Preliminary Design of a Range Correction Module for an Artillery Shell, Mar. 1996, Army Research Laboratory, ARL–MR–298.

*Primary Examiner*—Charles Jordan
*Assistant Examiner*—Christopher K. Montgomery
*Attorney, Agent, or Firm*—Paul Clohan

[57] ABSTRACT

A range correction module which is designed to fit onto a spin stabilized ballistic projectile for correcting range error. The range correction module is a self-contained module within the fuze which screws into the forward portion of the projectile. The range correction module is designed such that changes are not required to the existing projectile. During the course correction phase, semi-circular plates will deploy from the module. The plates create a blunt cross-sectional area in front of the projectile, thus creating more drag and effectively slowing the projectile.

5 Claims, 4 Drawing Sheets

RANGE CORRECTION MODULE FOR A SPIN STABILIZED PROJECTILE

GOVERNMENTAL INTEREST

The invention described herein may be manufactured, used and licensed by or for the United States Government without payment to us of any royalty thereon.

CROSS-REFERENCE TO RELATED APPLICATION

The subject matter of this application is related to that disclosed in copending application Ser. No. 08/738,488 filed Oct. 28, 1996, now abandoned.

TECHNICAL FIELD

The present invention relates to tube launched projectiles in general, and specifically to a device for one-dimensional trajectory (range) control of spin stabilized projectiles.

BACKGROUND ART

It was well recognized in the prior art that a tube launched projectile followed a ballistic trajectory which could be fairly well calculated. This knowledge enabled a gunner to fire a projectile to impact a preselected target area with reasonable accuracy and consistency. However, a major disadvantage of a ballistic projectile was the inability to control its trajectory after launch. Course correction is difficult with these types of projectiles. It is well known that the major source of trajectory error is in range, not deflection, for a ballistic projectile. As shown in FIG. 1, projectile 20 is fired from gun tube 24 at intended target B, but due to wind and other meteorological conditions, muzzle velocity error, aiming error, etc., projectile 20 actually impacts at point A. With current technology, at some point along the trajectory of projectile 20, the impact point error can be determined, but a course correction was not possible once projectile 20 leaves gun tube 24.

If course correction was available, the gunner could deliberately aim past the target. Then, during the flight of the projectile, a combination of on-board electronics such as a Global Positioning Sensor (GPS), and/or an Inertial measurement Unit (IMU), and a Central Processing Unit (CPU) would determine the actual ballistic path and predicted point of impact with respect to the intended trajectory and target location. A trajectory (range) control device could be preprogrammed with the intended trajectory before the projectile is fired. At a certain point in the flight, the CPU would determine when to initiate the trajectory (range) control device. Once initiated, the projectile will slow down, ultimately bringing it closer to the intended target.

STATEMENT OF THE INVENTION

It is therefore an object of the present invention to provide a simple range correction fuze/module for a spin stabilized ballistic projectile that will enhance range accuracy.

A further object of the present invention is to provide a range correction fuze/module that will provide a cost effective solution to correcting range error in spin stabilized ballistic projectiles.

Still other objects and advantages of the present invention will become readily apparent to those skilled in this art from the detailed description, wherein only the preferred embodiment of the present invention is shown and described, simply by way of illustration of the best mode contemplated of carrying out the present invention. As will be realized, the present invention is capable of other and different embodiments, and its several details are capable of modifications in various obvious respects, all without departing from the present invention. Accordingly, the drawings and descriptions are to be regarded as illustrative in nature, and not as restrictive.

These and other objects are achieved by a range correction device designed to be integrated into the fuze of a spin stabilized ballistic projectile. To minimize the impact on the projectiles overall aerodynamic profile, and physical characteristics, the device is very compact. Our range correction device is also a very cost effective solution to correcting range error. Our range correction module is completely integrated into the fuze, which will screw into the forward portion of the projectile. The mechanisms involved in our device require the fuze "envelope" to be lengthened by about 1.25 cm. This will maintain an overall length of the artillery projectile (including the fuze) of no more than one meter. During the course correction phase, four semi-circular plates will deploy from the module. The plates create a blunt cross-sectional area in front of the projectile, thus creating more drag and effectively slowing the projectile.

DETAILED DESCRIPTION OF THE PREFERRED EMBODIMENT

Figure 1:
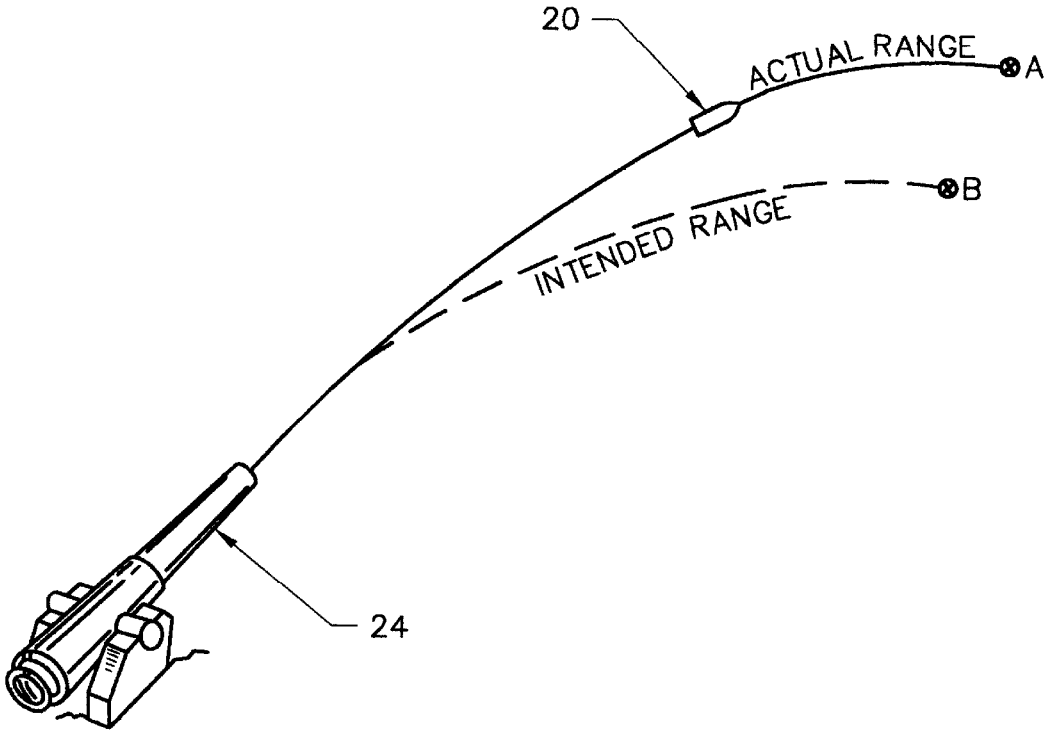
FIG. 1 depicts the intended path and the actual path of a projectile fired from a gun tube.
Figure 2:
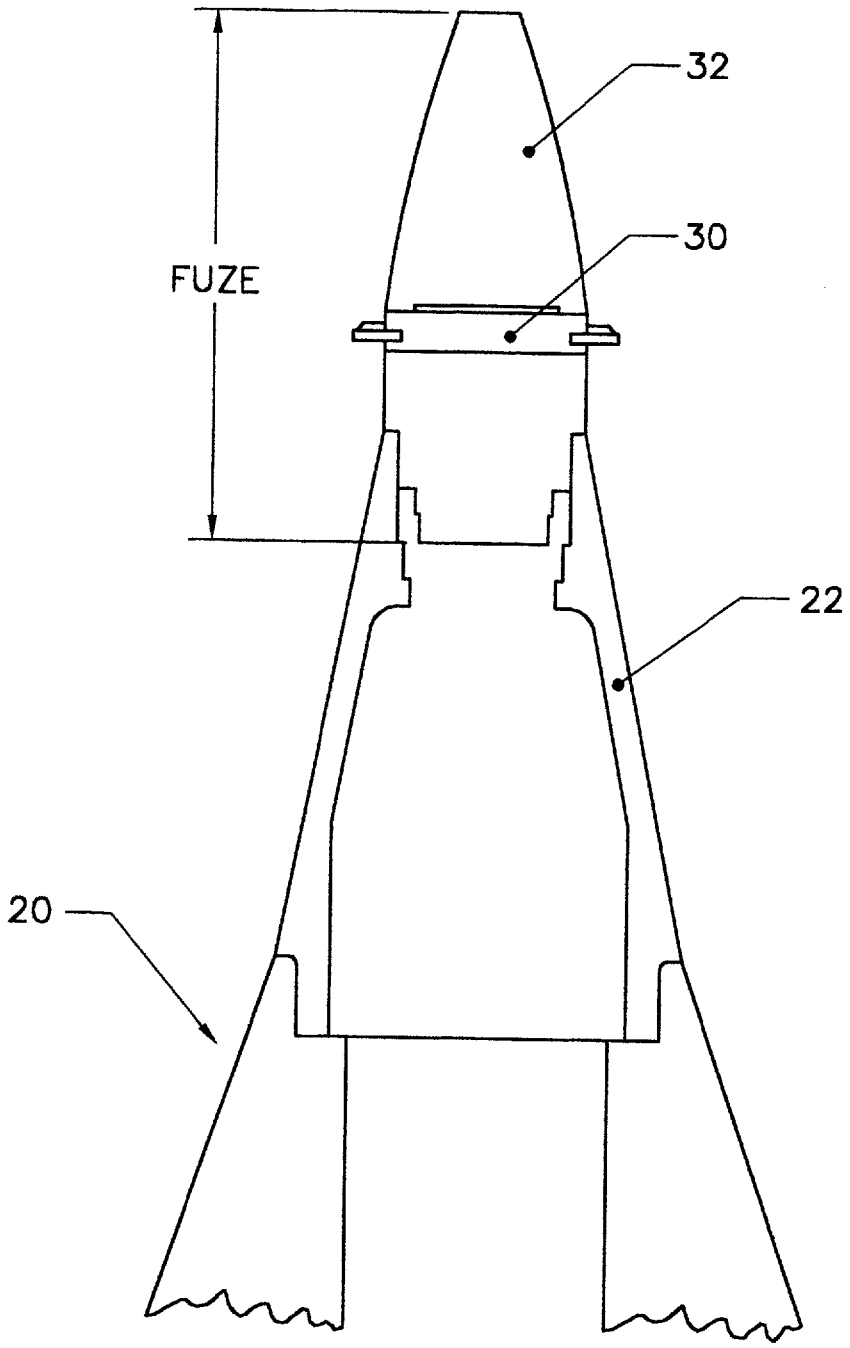
FIG. 2 depicts the forward portion of a spin stabilized ballistic projectile with our range correction fuze/module attached.

Referring now in detail to the drawings wherein like parts are designated by like reference numerals throughout, there is illustrated in FIG. 2 the forward end of ogive 22 of a spin stabilized ballistic projectile 20 incorporating our range correction device 30, which is a self-contained module within fuze 32 which screws into the forward end 22 of spin stabilized ballistic projectile 20. Range correction module 30 has a small hollow bushing that will coincide with the center of fuze 32 and the center of projectile forward end 22. This hollow bushing is intended to provide a conduit through which wires can pass through to provide electrical connections between the forward and aft components of module 30. The intent of range correction module 30 is to provide a device that will not require modification to existing projectiles.

Figure 3A:
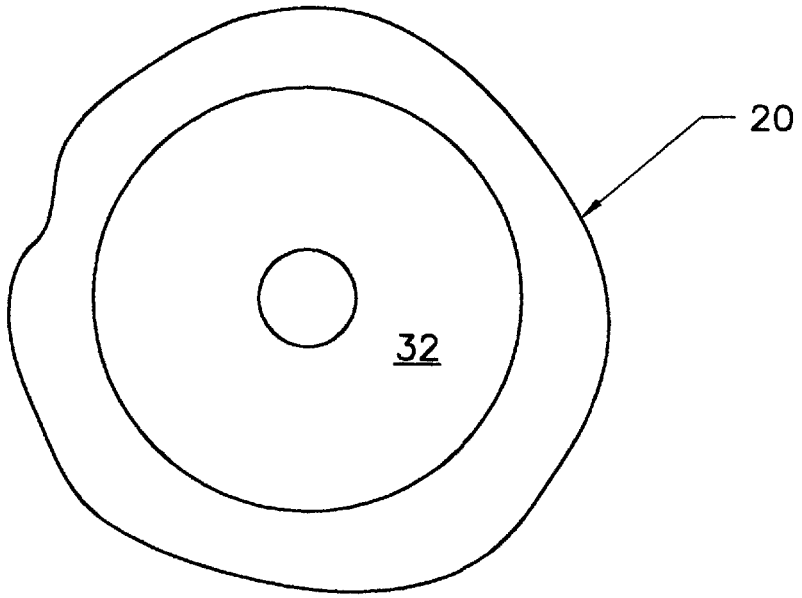
FIG. 3A is a front view of a spin stabilized projectile before deployment of our range correction module.
Figure 3B:
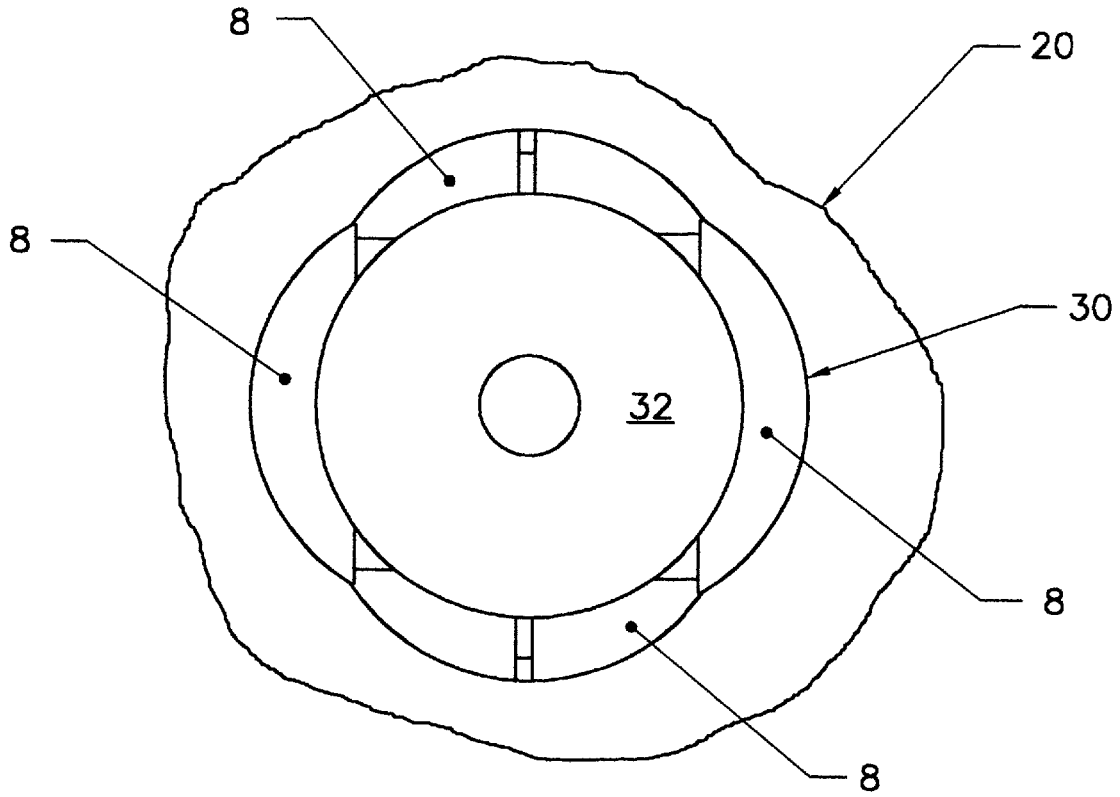
FIG. 3B is a front view of a spin stabilized projectile after deployment of our range correction module.

A view of the front of spin stabilized projectile 20 before deployment can be seen in FIG. 3A. During the course correction phase, four semi-circular plates 8 will deploy from range correction module 30. A view of the front of spin stabilized projectile 20 after the semi-circular plates have been deployed can be seen in FIG. 3B. The plates create a blunt cross sectional area in front of projectile 20, thus creating more drag and effectively slowing projectile 20.

Figure 4:
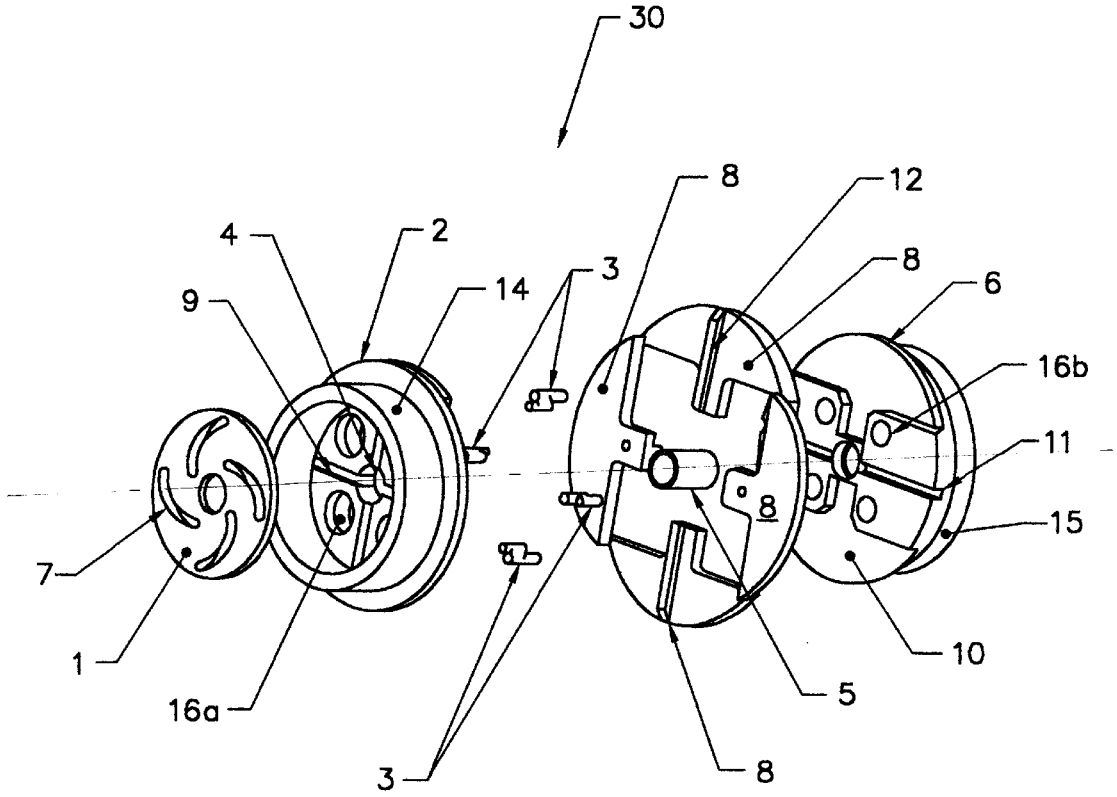
FIG. 4 is an exploded view of the components of our range correction device.

An exploded view of range correction module 30 is shown in FIG. 4. Module 30 consists of cam plate 1, forward guide plate 2, four guide pins 3, four semi-circular plates 8, hollow bushing 5, and rear guide plate 6. Cam plate 1 is allowed to pivot about hollow bushing 5. Contained within cam plate 1 are four curved slots 7 in which guide pins 3 are allowed to slide within. Forward guide plate 2 and rear guide plate 6 have several specific functions. Both house hollow bushing 5 in the center 4. Only forward guide plate 2 contains cruciform slots 9 which also guide the guide pins 3. There are two regions in which semi-circular plates 8 are seated before they are deployed. These two regions are the same two regions 10 on rear guide plate 6 except they are at ninety degrees to forward guide plate 2. There are also two grooves 11 into which the rails 12 from two of semi-circular plates 8 slide into. Forward guide plate 2 contains four holes 16*a* for four screws (not shown) that will thread into four holes 16*b* in rear guide plate 6. Forward guide plate 2 and rear guide plate 6 constrain the motion of the semi-circular plates 8 such that plates 8 can only slide in and out. Lastly, forward guide plate 2 has a threaded region 14 for attaching to fuze 32, and rear guide plate 6 also contains a threaded region 15 for attaching the ogive portion of the fuze 32. The four guide pins 3 are attached to the four plates 8 and are links between cam plate 1 and plates 8.

An example of the deployment of semi-circular plates 8, for an artillery projectile, would be a one-time course correction. The deployment will be aided by the centripetal forces due to the high rate of spinning by projectile 20. The forces will pull plates 8 out of the respective seating places. The motion of plates 8 is translated to cam plate 1 via guide pins 3. Cam plate 1 insures that plates 8 deploy in unison. Cam plate 1 also restrains plates 8 from completely ejecting from the mechanism. The extension of plates 8 could also be aided by a miniature actuator device, a DC brushless motor, fluidics, hydraulics, or any other suitable control system. The deployment of plates 8 can be made to be a one-time deployment, or multiple deployments for variable drag corrections.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A device to control the range of trajectory of a spin stabilized projectile having an aft body and a fuze located in the nose of the projectile comprising:

a projectile launched from a gun tube that is stabilized by spin;

an add-on drag producing module removably located in the forward portion of said projectile between the aft body of said projectile and the fuze of said projectile;

said module having attachment means on either end designed to mate with said fuze and said projectile such that said module can be attached to said projectile at a time prior to launch of said projectile by removing the fuze from said projectile, attaching one end of said module to said projectile body, and then re-attaching said fuze to the other end of said module;

said module also comprising means for extending into the airstream a plurality of flat planar tab-like projections such that said flat planar tab-like projections are extended into the airstream such that the surface having a greater cross-sectional area of each tab-like projection is perpendicular to said airstream thereby creating an overall blunt cross sectional area in the forward portion of said projectile immediately behind said fuze so as to create drag on said projectile and to slow said projectile during flight and thereby alter the trajectory of said projectile;

wherein the means for extending is a rotatable cam plate within said module.

2. The device of claim 1 wherein the rotatable cam plate is assisted by the centripetal forces acting on said module due to the spinning motion of said projectile.

3. The device of claim 2 wherein the rotation of said cam plate is limited to a one time rotation.

4. The device of claim 2 wherein the rotation of said cam plate is not limited to a one time rotation.

5. The device of claim 2 comprising 4 flat planar tab-like projections.

* * * * *